US010719021B2

(12) United States Patent
Jan

(10) Patent No.: US 10,719,021 B2
(45) Date of Patent: Jul. 21, 2020

(54) METALLIC TONER COMPRISING METAL INTEGRATED PARTICLES

(71) Applicant: Xerox Corporation, Rochester, NY (US)

(72) Inventor: Linda Jan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/367,755

(22) Filed: Dec. 2, 2016

(65) Prior Publication Data

US 2018/0157184 A1 Jun. 7, 2018

(51) Int. Cl.
*G03G 9/08* (2006.01)
*G03G 9/097* (2006.01)
(Continued)

(52) U.S. Cl.
CPC ..... *G03G 9/0804* (2013.01); *G03G 9/0812* (2013.01); *G03G 9/0819* (2013.01); *G03G 9/0825* (2013.01); *G03G 9/0827* (2013.01); *G03G 9/08782* (2013.01); *G03G 9/08784* (2013.01); *G03G 9/08795* (2013.01); *G03G 9/08797* (2013.01); *G03G 9/09* (2013.01); *G03G 9/0902* (2013.01); *G03G 9/0904* (2013.01); *G03G 9/0926* (2013.01); *G03G 9/09328* (2013.01); *G03G 9/09392* (2013.01); *G03G 9/09708* (2013.01); *G03G 9/09783* (2013.01)

(58) Field of Classification Search
CPC .. G03G 9/0804; G03G 9/0827; G03G 9/0819; G03G 9/09328; G03G 9/09392; G03G 9/0904
See application file for complete search history.

(56) References Cited

U.S. PATENT DOCUMENTS 4,298,672 A 11/1981 Lu
4,338,390 A 7/1982 Lu
(Continued)

FOREIGN PATENT DOCUMENTS

EP 2098574 A2 9/2009
EP 3217222 A1 9/2017
(Continued)

OTHER PUBLICATIONS

Varun Sambhy, et al., U.S. Appl. No. 15/067,426, filed Mar. 11, 2016, "Metallic Toner Compositions," not yet published.
(Continued)

*Primary Examiner* — Mark A Chapman
(74) *Attorney, Agent, or Firm* — Marylou J. Lavoie, Esq. LLC

(57) ABSTRACT

A toner and a toner process including providing at least one hybrid metallic toner component selected from the group consisting of hybrid metallic-latex particles, hybrid metallic-wax particles, hybrid metallic-colorant particles, and combinations thereof; contacting the at least one hybrid metallic toner component with one or more components selected from the group consisting of a latex polymer, a wax; and a colorant to form a blend; heating the blend at a temperature below the glass transition temperature of the latex polymer to form aggregated toner particles; adding a coalescing agent to the toner particles thereby coalescing the toner particles; and recovering the toner particles.

23 Claims, 1 Drawing Sheet

(51) Int. Cl.

| | |
|---|---|
| ***G03G 9/09*** | (2006.01) |
| ***G03G 9/087*** | (2006.01) |
| ***G03G 9/093*** | (2006.01) |

(56) References Cited

U.S. PATENT DOCUMENTS

| | | | | |
|---|---|---|---|---|
| 4,935,326 | A | 6/1990 | Creatura et al. | |
| 4,937,166 | A | 6/1990 | Creatura et al. | |
| 4,948,692 | A | 8/1990 | Higashimura et al. | |
| 5,385,960 | A * | 1/1995 | Emmons | B82Y 30/00 523/200 |
| 6,376,147 | B1 * | 4/2002 | Bonsignore | G03G 9/122 430/114 |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 8,039,183 | B2 * | 10/2011 | Veregin | G03G 9/08755 430/108.1 |
| 8,916,320 | B2 | 7/2014 | Qui et al. | |
| 9,181,389 | B2 | 11/2015 | Farrugia et al. | |
| 9,290,637 | B2 | 3/2016 | Lee et al. | |
| 9,348,248 | B2 | 5/2016 | Qiu et al. | |
| 9,777,125 | B2 * | 10/2017 | Chen | C08J 3/215 |
| 2005/0214666 | A1 | 9/2005 | Schulze-Hagenest et al. | |
| 2009/0084028 | A1 * | 4/2009 | Dieckmann | D06N 3/042 44/500 |
| 2009/0111040 | A1 | 4/2009 | Veregin et al. | |
| 2014/0342279 | A1 | 11/2014 | Chun et al. | |
| 2014/0356778 | A1 | 12/2014 | Wolfe et al. | |
| 2015/0268572 | A1 * | 9/2015 | Takahashi | G03G 9/0827 430/108.3 |
| 2016/0085169 | A1 | 3/2016 | Hirai et al. | |

FOREIGN PATENT DOCUMENTS

| | | | |
|---|---|---|---|
| WO | WO 2005076086 | A1 | 8/2005 |
| WO | WO 2013103346 | A1 | 7/2013 |
| WO | WO 2015167473 | A1 | 11/2015 |

OTHER PUBLICATIONS

Guerino G. Sacripante, et al., U.S. Appl. No. 15/053,695, filed Feb. 25, 2016, "Toner Composition and Process," not yet published.

Hong et al., "Clusters of Amphiphilic Colloidal Spheres," Langmuir, 2008, 24, pp. 621-625, published on web Jan. 9, 2008.

Extended European Search Report issued in European Application No. 17203936.4-1107, dated Mar. 29, 2018, 8 pages.

Canadian Office Action issued in Canadian Application No. 2,986,539, dated Nov. 26, 2018, 3 pages.

Canadian Office Action issued in Canadian Application No. 2,986,539, dated Jun. 20, 2019, 3 pages.

* cited by examiner

METALLIC TONER COMPRISING METAL INTEGRATED PARTICLES

BACKGROUND

Disclosed herein is a toner comprising a hybrid metallic component and a toner process comprising providing at least one hybrid metallic toner component selected from the group consisting of hybrid metallic-latex particles, hybrid metallic-wax particles, hybrid metallic-colorant particles, and combinations thereof; contacting the at least one hybrid metallic toner component with one or more components selected from the group consisting of a latex polymer, a wax; and a colorant to form a blend; heating the blend at a temperature below the glass transition temperature of the latex polymer to form aggregated toner particles; adding a coalescing agent to the toner particles thereby coalescing the toner particles; and recovering the toner particles.

Conventional printing systems for toner applications consist of four stations comprising cyan, magenta, yellow, and black (CMYK) toner stations. Xerox® Corporation is developing printing systems including the concept of a fifth xerographic station to enable gamut extension via the addition of a fifth color or specialty colors. At any given time the machine can run CMYK toners plus a fifth color in the fifth station. To further increase the capability of the new systems and provide novelty printing capability to customers, it is desirable to develop a metallic ink formulation to also be run in the fifth station. Toners capable of making metallic hues, especially silver or golden, are particularly desired by print shop customers for their esthetic appeal, for example, on wedding cards, invitations, advertising, etc. Metallic hues cannot be obtained from CMYK primary color mixtures.

U.S. Pat. No. 8,039,183, which is hereby incorporated by reference herein in its entirety, describes in the Abstract thereof a pigment particle coated with at least one of a resin and a charge control surface additive, wherein the pigment particle is a pearlescent or metallic pigment. The pigments adds pearlescent effects and is of a size and charge as to be used as a toner material in electrostatographic or xerographic image formation.

A requirement for achieving a metallic effect is incorporation of a flat reflective pigment in a toner that can reflect light and give the desired metallic effect. Aluminum flake pigments are one possible choice for preparing metallic silver toner due to their commercial availability and low cost. However, there are challenges regarding use of aluminum flake pigments to create metallic hue silver toners. For example, such toners may possess a low charge due to increased conductivity of the aluminum pigment. It is difficult to incorporate large aluminum metal flake pigment into toner. It is also difficult to optimize the orientation of aluminum flake pigment in order to achieve maximum metallic hue. Further, there are safety concerns with processing and handling of explosive aluminum powders. For example, in preparation of toner by conventional processes including melt mixing pigment into resin followed by grinding, classification, and additive blending, there is a danger of sparking from the conductive aluminum during the grinding step.

Preparing metallic colored toner (e.g., silver or gold) using emulsion aggregation (EA) processes typically comprises preparing a dispersion containing metallic pigment (e.g., aluminum) and adding the metallic pigment dispersion to a mixture of a raw toner materials dispersion during controlled aggregation. Handling of dry metallic pigment can pose safety concerns such as powder explosion. There can also be difficulties incorporating the metallic pigment into the toner particle during aggregation and coalescence.

Thus, while currently available toners and toner processes are suitable for their intended purposes, there remains a need for an improved metallic toner and process for preparing same. There further remains a need for a viable process for preparing silver metallic toner. There further remains a need for an improved metallic toner and metallic toner particle that be used as a raw material dispersion in an emulsion aggregation process.

The appropriate components and process aspects of each of the U.S. Patents and Patent Publications referenced herein may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner process comprising providing at least one hybrid metallic toner component selected from the group consisting of hybrid metallic-latex particles, hybrid metallic-wax particles, hybrid metallic-colorant particles, and combinations thereof; contacting the at least one hybrid metallic toner component with one or more components selected from the group consisting of a latex polymer, a wax; and a colorant to form a blend; heating the blend at a temperature below the glass transition temperature of the latex polymer to form aggregated toner particles; adding a coalescing agent to the toner particles thereby coalescing the toner particles; and recovering the toner particles.

Also described is a toner comprising at least one hybrid metallic toner component selected from the group consisting of hybrid metallic-latex particles, hybrid metallic-wax particles, hybrid metallic-colorant particles, and combinations thereof; an optional resin; an optional wax; an optional colorant.

DETAILED DESCRIPTION

Figure 1:
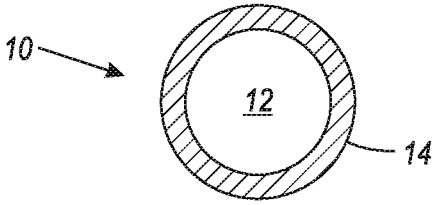
FIG. 1 is an illustration of a hybrid metallic toner component in accordance with the present embodiments.

In embodiments, a toner herein comprises at least one hybrid metallic toner component selected from the group consisting of hybrid metallic-latex particles, hybrid metallic-wax particles, hybrid metallic-colorant particles, and combinations thereof; an optional resin; an optional wax; an optional colorant.

The safety concerns surrounding handling of metallic pigment, particularly the concern of powder explosion, are solved by the present toner and toner process comprising coating one or more selected raw toner components, in embodiments, latex, pigment, wax, and combinations thereof, with a metallic coating to obtain a hybrid metallic component and using the hybrid metallic coated toner component in a controlled toner aggregation process in place of, for example, aluminum flakes. The raw material dispersion can be dried, and coated via evaporative techniques such as sputter coating or e-beam deposition. The coated particle obtained is a hybrid between metal and one of the raw materials. While not wishing to be bound by theory, it is believed that the hybrid coated particle provides improved compatibility and improved incorporation of these hybrid particles during the toner aggregation process compared to metal particles. The hybrid particle provides reduced explosion hazard or, in embodiments, eliminates the explosion hazard altogether. A base dispersion used for coating the metal layer thereover is not limited to spherical particles, but can be of any shape and size tailored for function or safety concerns.

Thus, the raw toner component comprising the core of the hybrid particle herein may comprise any suitable or desired shape or configuration. Exemplary shapes can include, without limitation, needle-shaped, granular, globular, platelet-shaped, acicular, columnar, octahedral, dodecahedral, tubular, cubical, hexagonal, oval, spherical, dendritic, prismatic, amorphous shapes, and the like. An amorphous shape is defined in the context of the present disclosure as an ill defined shape having a recognizable shape. For example, an amorphous shape has no clear edges or angles. In embodiments, the ratio of the major to minor size axis of the single nanocrystal (D major/D minor) can be less than about 10:1, less than about 2:1, or less than about 3:2. In a specific embodiment, the magnetic core has a needle-like shape with an aspect ratio of about 3:2 to less than about 10:1.

In embodiments, the hybrid metallic component comprises a spherical shape having an average particle size (such as particle diameter or longest dimension) total size including core and metallic coating of from about 3 to about 500 nanometers (nm), or about 10 to about 500 nm, or about 10 to about 300 nm, or about 10 to about 50 nm, or about 5 to about 100 nm, or about 2 to about 20 nm, or about 25 nm. In embodiments, the metal layer is a thin film layer having a thickness of from about 1 nanometer to about 10 nanometers. Herein, "average" particle size is typically represented as $d_{50}$, or defined as the volume median particle size value at the 50th percentile of the particle size distribution, wherein 50% of the particles in the distribution are greater than the $d_{50}$ particle size value, and the other 50% of the particles in the distribution are less than the $d_{50}$ value. Average particle size can be measured by methods that use light scattering technology to infer particle size, such as Dynamic Light Scattering. The particle diameter refers to the length of the pigment particle as derived from images of the particles generated by Transmission Electron Microscopy or from Dynamic Light Scattering measurements.

The hybrid metallic toner component can be used for any suitable or desired application, in embodiments, for print products with metallic dispersions.

The hybrid metallic toner component can be prepared by any suitable or desired process. In embodiments, a process herein comprises drying a dispersion of base particulate, wherein the base particulate can comprise any suitable or desired base particulate component, in embodiments, colorant, latex or wax, using any suitable or desired method, including, but not limited to, spray drying or freeze drying.

Next, the process comprises spreading the dried powder onto a substrate (e.g., glass) and depositing a thin metal layer onto the particle surface. The thin metal layer can be deposited using any suitable or desired process, in embodiments, using thin layer metal deposition equipment, such as a sputter coater or e-beam deposition device. In embodiments, a sputter coater can be selected for conformal coating and an e-beam coater for directional coating.

In embodiments, the metal layer is a thin film layer having a thickness of from about 1 nanometer to about 200 nanometers.

The thin film of metal can comprise any suitable or desired metal, in embodiments, aluminum, gold, silver, zinc, copper-zinc alloys, chromium, platinum, titanium, and combinations thereof. In embodiments, the metal is aluminum flake.

The selected particle can be coated with the thin metal layer in whole or in part. That is, the particle can be coated with the metal layer over essentially all of the particle surface; that is, fully coated. Alternatively, the particle can be partially coated with the metal layer over any desired selected portion of the particle surface.

FIG. 1 illustrates a hybrid metallic toner component 10 comprising a core 12 and a metal coating 14 disposed thereover wherein the metal coating 14 covers essentially all of the surface of the core 12. Core 12 can be any suitable or desired raw toner component, for example, a latex particle, a wax particle, or a colorant.

Figure 2:
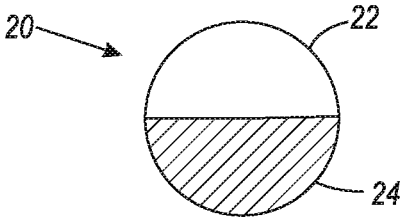
FIG. 2 is an illustration of an alternate hybrid metallic toner component in accordance with the present embodiments.

In embodiments, the particle can be coated with metal layer in such a way as to form a so-called "Janus" or two-sided particle, wherein one side, or approximately half of the particle surface, is coated with the metal layer, and the other side, is uncoated. FIG. 2 illustrates an embodiment comprising a hybrid metallic toner component 20 comprising a core particle 22 having approximately half of the particle surface coated with metal layer 24 forming a "Janus" particle wherein half of the surface comprising the core 22, in embodiments, latex particle, wax particle, or colorant particle, and wherein half of the surface comprises the metal coating layer 24.

Figure 3:
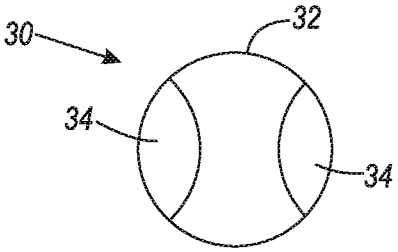
FIG. 3 is an illustration of another hybrid metallic toner component in accordance with the present embodiments.

In other embodiments, the particle can be selectively coated with metal on portions of the surface, for example to form a desired pattern, while other portions are left uncoated. FIG. 3 illustrates an embodiment comprising a hybrid metallic toner component 30 comprising a core 32 and a metallic layer 34 disposed in a pattern over portions of the core 32 surface. As described herein, the core 32 can be any suitable or desired raw toner component, in embodiments, a latex particle, a wax particle, or a colorant. As described herein, the metallic layer can be any suitable or desired metallic layer. In embodiments, the metallic layer can comprise a single metal or a combination of metals. In other embodiments, portions of the core particle can be coated with a first metal and portions of the core particle can be coated with a second, different metal.

In still other embodiments, the particle can be partially coated with the metal layer and partially coated with a second layer wherein the second layer can comprise a different metal or a non-metal coating. Such non-metal coatings can be any suitable or desired coating.

In still other embodiments, the particle can be fully or partically coated and functionalized in a variety of manners, including grafting by conjugation and thiol chemistries, grafting of DNA and RNA oligomers, etc.

Figure 4:
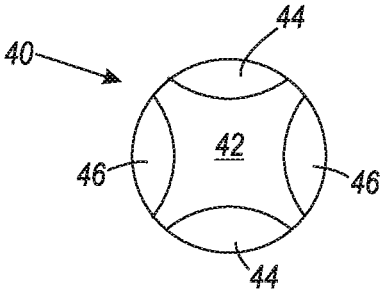
FIG. 4 is an illustration of yet another hybrid metallic toner component in accordance with the present embodiments.

FIG. 4 illustrates an embodiment wherein a hybrid metallic toner component 40 comprises a core 42, a first metal coating 44 disposed in a pattern over portions of the core 42 surface, and a second coating 46 disposed in a pattern over portions of the core 42 surface, wherein the second coating 46 is a second metal that is different from the first metal 44 or wherein the second coating 46 is a non-metal coating.

For example, partially metal coated particles which have amphiphilic characteristics (hydrophobic and metallic on one side and charged on the other side) can be prepared as follows.

Amphiphilic colloidal spheres, fluorescent carboxylate-modified polystyrene spheres are spread onto a cleaned glass slide and coated on the exposed hemisphere with a thin (30 nm) film of gold. Subsequently, a monolayer of octadecanethiol (ODT) is assembled on the gold using conventional thiol chemistry. The untreated hemisphere has a high negative charge density resulting from carboxylic acid groups on the parent colloidal sphere.

To prepare the hydrophobic patch on the spheres, a suspension of (fluorescent) carboxylate-modified polystyrene spheres is spread onto a cleaned glass slide such that a monolayer of colloids remains after the suspension liquid evaporates. A thin (30 nm) film of gold is deposited using electron beam deposition onto a titanium adhesion-promoting layer (2 nm). Onto the gold hemisphere surfaces, monolayers of octadecanethiol (ODT) are deposited and washed multiple times first with 1% HCl-ethanol solution and then with deionized water to remove nonspecific adsorption.

By adjusting electrolyte ionic strength and tailoring the hydrophobicity and electrostatic charges on these particles, the particles can self-assemble (or aggregate) into structures of various sizes and shapes. For further detail, see Hong, L.; Cacciuto, A., Luijten, E., Granick, S., "Clusters of Amphiphilic Colloidal Spheres," Langmuir 2008, 24, 621-625, which is hereby incorporated by reference herein in its entirety.

The process further comprises dispersing the metal coated particles in an electrolyte with surfactant, in embodiments, using sonication or shear to break up aggregates in a similar manner as making a pigment dispersion. The thus obtained dispersion of hybrid metal toner particle, can be used as a raw material dispersion in any emulsion aggregation AC process as in place of metal pigment. The present "pigment" is a metal-organic hybrid instead of an all metal pigment. The metal-organic hybrid particle provides the advantage of better compatibility with the other components of the toner composition, inclusion of the hybrid pigment in the particle, and safer handling of dry pigment in powder state.

Particle size, shape, surface properties, and electrolyte adjustment can be altered as desired for aggregation and coalescence to obtain the required characteristics for the particle and toner.

In embodiments, a toner process herein comprises providing at least one hybrid metallic toner component selected from the group consisting of hybrid metallic-latex particles, hybrid metallic-wax particles, hybrid metallic-colorant particles, and combinations thereof; contacting the at least one hybrid metallic toner component with one or more components selected from the group consisting of a latex polymer, a wax; and a colorant to form a blend; heating the blend at a temperature below the glass transition temperature of the latex polymer to form aggregated toner particles; adding a coalescing agent to the toner particles thereby coalescing the toner particles; and recovering the toner particles.

In embodiments, the at least one hybrid metallic toner component is a hybrid metallic-latex particle comprising a resin latex particle having a surface and a metal layer disposed on the latex particle surface; wherein the metal layer is disposed so as to form a coating over essentially all of the latex particle surface; or wherein the metal layer is disposed so as to form a coating over a portion of the latex particle surface. In further embodiments, a portion of the latex particle surface is coated with a first metal layer and a separate portion of the latex particle surface is coated with a second metal layer that is different from the first metal layer. In still further embodiments, a portion of the latex particle surface is coated with one or more metal layers and a separate portion of the latex particle surface is coated with a non-metal coating. Any suitable or desired non-metal coating can be selected, including functionalization of the surface using a variety of methods, including utilizing conjugate and thiol chemistries, grafting of DNA and RNA oligomers, etc. In embodiments, the at least one hybrid metallic toner component is a hybrid metallic-latex particle comprising a resin latex particle having disposed thereon a metal layer, wherein the metal is selected from the group consisting of aluminum, gold, silver, zinc, platinum, chromium, titanium, copper-zinc alloys, and combinations thereof.

Latex Particle.

The latex particles can be formed by any suitable or desired process. In embodiments wherein the hybrid metal toner component is a hybrid metallic-latex particle, the formed latex particles can be dried using any suitable or desired method including, but not limited to, spray drying or freeze drying. The dried latex particles are then spread onto a substrate, such as glass, and coated with a thin film of metal. The metal can be coated onto the latex particle using any suitable or desired process. In embodiments, the metal layer is coated onto the latex particle using a thin metal deposition process, such as sputter coating or e-beam deposition. In embodiments, sputter coating is selected for conformal coating and e-beam coating is selected for directional coating. In embodiments, the metal layer is a thin film layer having a thickness of from about 1 nanometer to about 500 nanometers. In embodiments, the metal layer is a thin film layer having a thickness of from about 1 nanometer to about 10 nanometers. The coated latex particles can be dispersed in an electrolyte with surfactant using any suitable or desired process, such as sonication or shear, to break up aggregates in a similar manner as used when preparing a pigment dispersion. The formed hybrid metal-latex particle is then used as a raw material dispersion in a toner process, in embodiments, an emulation aggregation process, in place of metal pigment. Thus, the toner herein comprises a "pigment" which is a metal-organic hybrid instead of an all metal pigment. The latex particle can be formed from any suitable or desired resin or polymer.

Resin.

Any suitable or desired resin can be used in the processes herein. The resin or polymers can be used to form the hybrid metallic-latex particle. The resin or polymers can also be used for any additional resin or polymer that is desirably included in the toner. In embodiments, the toner resin can be an amorphous resin, a crystalline resin, or a mixture or combination thereof. In further embodiments, the resin can be a polyester resin, including the resins described in U.S. Pat. Nos. 6,593,049 and 6,756,176, which are each hereby incorporated by reference herein in their entireties. Suitable resins can also include a mixture of an amorphous polyester resin and a crystalline polyester resin as described in U.S. Pat. No. 6,830,860, which is hereby incorporated by reference herein in its entirety.

In embodiments, the resin is polyester. In certain embodiments, the resin is amorphous polyester, crystalline polyester, or a mixture thereof.

For forming a crystalline polyester, one or more polyol branching monomers can be reacted with a diacid in the presence of an optional catalyst and a further organic diol suitable for forming the crystalline resin including aliphatic diols having from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, and mixtures and combinations thereof, including their structural isomers. The aliphatic diol may be present in any suitable or desired amount, such as from about 25 to about 60 mole percent, or from about 25 to about 55 mole percent, or from about 25 to about 53 mole percent of the resin. In embodiments, a third diol can be selected from the above-described diols in an amount of from about 0 to about 25 mole percent, or from about 1 to about 10 mole percent of the resin.

Examples of organic diacids or diesters including vinyl diacids or vinyl diesters that can be selected for the preparation of the crystalline resin include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, a diester or anhydride thereof, and mixtures and combinations thereof. The organic diacid can be present in any suitable or desired amount, in embodiments, from about 25 to about 60 mole percent, or from about 25 to about 52 mole percent, or from about 25 to about 50 mole percent. In embodiments, a second diacid can be selected from the above-described diacids and can be present in an amount of from about 0 to about 25 mole percent of the resin.

For forming crystalline polyester, one or more polyacid branching monomers can be reacted with a diol in the presence of an optional catalyst and a further organic diacid or diester. The components can be selected in any suitable or desired ratio. In embodiments, the branching monomer can be provided in an amount of from about 0.1 to about 15 mole percent, or from about 1 to about 10 mole percent, or from about 2 to about 5 mole percent, and, in embodiments, a second branching monomer can be selected in any suitable or desired amount, in embodiments, from about 0 to about 10 mole percent, or from about 0.1 to about 10 mole percent of the robust resin.

Examples of diacids or diesters suitable for use in forming the resin herein include vinyl diacids or vinyl diesters used for the preparation of amorphous polyester resins including dicarboxylic acids or diesters such as terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, lutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethladipate, dimethyl dodecylsuccinate, and mixtures and combinations thereof.

The organic diacid or diester may be present in any suitable or desired amount, such as from about 35 to about 60 mole percent of the resin, or from about 42 to about 52 mole percent of the resin, or from about 45 to about 50 mole percent of the resin.

Examples of diols which may be used to prepared the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cycloheaxanediol, diethylene glycol, bis(2-hydroxyethyl) oxide, dipropylene glycol, dibutylene, and mixtures and combinations thereof.

The organic diol can be present in any suitable or desired amount, such as from about 35 to about 60 mole percent of the resin, or from about 42 to about 55 mole percent of the resin, or from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, and mixtures and combinations thereof. Such catalysts may be utilized in any suitable or desired amount, such as from about 0.01 mole percent to about 5 mole percent based on the starting diacid or diester used to generate the polyester resin.

The resin can be prepared by any suitable or desired method. For example, one or more monomers can be combined with one or more acid or diester components in the optional presence of a catalyst, heated, optionally in an inert atmosphere, to condense the monomers into prepolymers. To this mixture can be added one or more diacids or diesters, optionally additional catalyst, optionally a radical inhibitor, with heating, optionally under inert atmosphere, to form the desired final resin (polyester).

Heating can be to any suitable or desired temperature, such as from about 140° C. to about 250° C., or about 160° C. to about 230° C., or about 180° C. to about 220° C.

Any suitable inert atmosphere conditions can be selected, such as under nitrogen purge.

If desired, a radical inhibitor can be used. Any suitable or desired radical inhibitor can be selected, such as hydroquinone, toluhydroquinone, 2,5-DI-tert-butylhydroquinone, and mixtures and combinations thereof. The radical inhibitor can be present in any suitable or desire amount, such as from about 0.01 to about 1.0, about 0.02 to about 0.5, or from about 0.05 to about 0.2 weight percent of the total reactor charge.

In embodiments, the resin can be pre-blended with a weak base or neutralizing agent. In embodiments, the base can be a solid, thereby eliminating the need to use a solution, which avoids the risks and difficulties associated with pumping a solution.

In embodiments, the resin and the neutralizing agent can be simultaneously fed through a co-feeding process which may accurately control the feed rate of the neutralizing agent and the resin into an extruder and which may then be melt mixed followed by emulsification.

In embodiments, the neutralizing agent can be used to neutralize acid groups in the resins. Any suitable or desired neutralizing agent can be selected. In embodiments, the neutralizing agent can be selected from the group consisting of ammonium hydroxide, potassium hydroxide, sodium hydroxide, sodium carbonate, sodium bicarbonate, lithium hydroxide, potassium carbonate, and mixtures and combinations thereof.

The neutralizing agent can be used as a solid, such as sodium hydroxide flakes, etc., in an amount of from about 0.001% to about 50% by weight, or from about 0.01% to about 25% by weight, or from about 0.1% to about 5% by weight, based on the weight of the resin.

In certain embodiments, the neutralizing agent is a solid neutralizing agent selected from the group consisting of ammonium hydroxide flakes, potassium hydroxide flakes, sodium hydroxide flakes, sodium carbonate flakes, sodium bicarbonate flakes, lithium hydroxide flakes, potassium carbonate flakes, organoamines, and mixtures and combinations thereof.

In embodiments, the neutralizing agent can be sodium hydroxide flakes. In embodiments, the surfactant used can be an aqueous solution of alkyldiphenyloxide disulfonate to ensure that proper resin neutralization occurs when using sodium hydroxide flakes and leads to a high quality latex with low coarse content. Alternatively, a solid surfactant of sodium dodecyl benzene sulfonate can be used and co-fed with the resin into the extruder feed hopper eliminating the need to use a surfactant solution thereby providing a simplified and efficient process.

An emulsion formed in accordance with the present process can also include a small amount of water, in embodiments, deionized water, in any suitable or desired amount, such as from about 20% to about 300%, or from about 30% to about 150%, by weight of the resin, at temperatures that melt or soften the resin, such as from about 40° C. to about 140° C., or from about 60° C. to about 100° C.

Further, any other monomer suitable for preparing a latex for use in a toner may be utilized as the resin. As noted above, in embodiments, the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In embodiments, the resin is selected from the group consisting of styrenes, acrylates, methacrylates, butadienes, isoprenes, acrylic acids, methacrylic acids, acrylonitriles, and combinations thereof.

In certain embodiments, the resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

Surfactant.

In embodiments, the latex may be prepared in an aqueous phase containing a surfactant or co-surfactant. Surfactants which may be utilized with the polymer to form a latex dispersion can be ionic or nonionic surfactants, or combinations thereof, in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL® and ALKAQUAT® available from Alkaril Chemical Company, SANISOL (benzalkonium chloride), available from Kao Chemicals, combinations thereof, and the like. In embodiments a suitable cationic surfactant includes SANISOL® B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators.

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine] di-hydrochloride, 2,2'-azobis[N-(4-hydroxyphenyl)-2-methylpropionamidine]dihydrochloride, 2,2'-azobis[N-(4-aminophenyl)-2-methylpropionamidine]tetrahydrochloride, 2,2'-azobis[2-methyl-N(phenylmethyl)propionamidine] dihydrochloride, 2,2'-azobis[2-methyl-N-2-propenylpropionamidine]dihydrochloride, 2,2'-azobis[N-(2-hydroxy-ethyl) 2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

Chain Transfer Agent.

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer when emulsion polymerization is conducted in accordance with the present disclosure.

Additives.

In embodiments, the toner particles may further contain optional additives as desired or required. For example, the toner may include positive or negative charge control agents, such as in an amount of from about 0.1 to about 10%, or from about 1 to about 3% by weight of the toner. Examples of suitable charge control agents include quaternary ammonium compounds inclusive of alkyl pyridinium halides, bisulfates, alkyl pyridinium compounds, including those disclosed in U.S. Pat. No. 4,298,672, which is hereby incorporated by reference herein in its entirety, organic sulfate and sulfonate compositions, including those discloses in U.S. Pat. No. 4,338,390, which is hereby incorporated by reference herein in its entirety, cetyl pyridinium tetrafluoroborates, distearyl dimethyl ammonium methyl sulfate, aluminum salts such as CONTRON E84™ or E88™ (Orient Chemical Industries, Ltd.), and mixtures and combinations thereof.

There can also be blended with the toner particles external additive particles including flow aid additives, which additives may be present on the surface of the toner particles. Examples of these additives include metal oxides such as titanium oxide, silicon oxide, aluminum oxide, cerium oxide, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN® 700, and mixtures and combinations thereof.

Silica may be applied to the toner surface for toner flow, tribo enhancement, admix control, improved development and transfer stability, and higher toner blocking temperature. $TiO_2$ may be applied for improved relative humidity (RH) stability, tribo control, and improved development and transfer stability. Zinc stearate, calcium stearate and/or magnesium stearate may optionally also be used as an external additive for providing lubricating properties, developer conductivity tribo enhancement, enabling higher toner charge and charge stability by increasing the number of contacts between toner an carrier particles. In embodiments, a commercially available zinc stearate known as Zinc Stearate L, available from Ferro Corporation, may be used. The external surface additives may be used with or without a coating.

Each of these external additives may be present in any suitable or desired amount, such as from about 0.1 percent by weight to about 5 percent by weight of the toner, or from about 0.2 percent by weight to about 3 percent by weight of the toner.

The latex emulsion containing the resin or resins may be utilized to form a toner by any method within the purview of those skilled in the art. In embodiments, the latex emulsion is dried and coated with a metal layer as described herein to form the hybrid metallic-latex particle which is then used as a raw toner component in an emulsion aggregation toner process.

The latex emulsion may be contacted with an optional colorant, optionally in the form of a colorant dispersion, and other additives to form a toner by a suitable process, in embodiments, an emulsion aggregation and coalescence process. In embodiments, the toner processes herein employ the latex emulsions herein to produce particle sizes that are suitable for emulsion aggregation ultra low melt processes.

In embodiments, a toner process herein comprises providing an aqueous emulsion comprising at least one hybrid metallic toner component as described herein, an optional additional resin; an optional wax, and an optional colorant, and aggregating toner particles from the aqueous emulsion.

Optionally, the toner process further comprises coalescing the aggregated toner particles.

In embodiments, the toner process further comprises wherein the aggregated toner particles form a core, and further comprise, during aggregation, adding additional emulsion to form a shell over the core. In certain embodiments, the additional emulsion forming the shell is the same material as the emulsion forming the core. In other embodiments, the additional emulsion forming the shell can be different from the material forming the toner core.

In embodiments, the process further comprises adding a second latex polymer to the aggregated toner particles to form a shell over the aggregated toner particles thereby forming a core-shell toner; adding the coalescing agent to the toner particles, and subsequently heating the core-shell toner with the coalescing agent at a temperature above the glass transition temperature of the second latex polymer.

In embodiments, the second latex polymer comprises a latex polymer; or a second hybrid metallic-latex particle comprising a resin latex particle having a surface and a metal layer disposed on the latex particle surface, wherein the second hybrid metallic-latex particle is the same or different from the first hybrid metallic-latex particle.

In other embodiments, the toner herein can be formed by a process comprising homogenizing the resin emulsion with a surfactant, an optional colorant, an optional wax, and an optional coagulant to form a homogenized toner slurry comprising pre-aggregated particles at room temperature; heating the slurry to form aggregated toner particles; optionally freezing the toner slurry once at the desired aggregated particle size; and further heating the aggregated particles in the slurry to coalesce the aggregated particles into toner particles.

Heating to form aggregated toner particles may be to any suitable or desired temperature for any suitable or desired time. In embodiments heating to form aggregated toner particles may be to a temperature below the Tg of the latex, in embodiments to from about 30° C. to about 70° C. or to about 40° C. to about 65° C., for a period of time of from about 0.2 hour to about 6 hours, from about 0.3 hour to about 5 hours, in embodiments, resulting in toner aggregates of from about 3 microns to about 15 microns in volume average diameter, in embodiments of from about 4 microns to about 8 microns in volume average diameter, although not limited.

Freezing the toner slurry to stop particle growth once the desired aggregated particle size is achieved can be by any suitable or desired method. In embodiments, the mixture is cooled in a cooling or freezing step. In embodiments, the mixture is pH adjusted, such as by freezing the aggregation of the particles with a buffer solution having a pH of about 7 to about 12, over a period of from about 1 minute to about 1 hour, or to about 8 hours or from about 2 minutes to about 30 minutes. In embodiments, cooling a coalesced toner slurry includes quenching by adding a cooling medium such as, for example, ice, dry ice and the like, to effect rapid cooling to a temperature of from about 20° C. to about 40° C. or from about 22° C. to about 30° C.

Coalescing the aggregated particles into toner particles can be by any suitable or desired method. In embodiments, coalescing comprises further heating the aggregated particles in the slurry to coalesce the aggregated particles into toner particles. In embodiments, the aggregate suspension may be heated to a temperature at or above the Tg of the latex. Where the particles have a core-shell configuration, heating may be above the Tg of the first latex used to form the core and the Tg of the second latex used to form the shell, to fuse the shell latex with the core latex. In embodiments, the aggregate suspension may be heated to a temperature of from about 80° C. to about 120° C. or from about 85° C. to about 98° C., for a period of time from about 1 hour to about 6 hours or from about 2 hours to about 4 hours.

The toner slurry may then be washed. In embodiments, washing may be carried out at a pH of from about 7 to about 12 or from about 9 to about 11 and the washing may be at a temperature of from about 30° C. to about 70° C. or from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

In embodiments, drying may be carried out at a temperature of from about 35° C. to about 85° C. or from about 45° C. to about 60° C. The drying may be continued until the moisture level of the particles is below a set target of about 1% by weight, in embodiments of less than about 0.7% by weight.

pH Adjustment Agent.

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax Particle.

In embodiments, the at least one hybrid metallic toner component is a hybrid metallic-wax particle comprising a wax particle having a surface and a metal layer disposed on the wax particle surface; wherein the metal layer is disposed so as to form a coating over essentially all of the wax particle surface; or wherein the metal layer is disposed so as to form a coating over a portion of the wax particle surface.

In further embodiments, a portion of the wax particle surface is coated with a first metal layer and a separate portion of the wax particle surface is coated with a second metal layer that is different from the first metal layer. In still further embodiments, a portion of the wax particle surface is coated with one or more metal layers and a separate portion of the wax particle surface is coated with a non-metal coating. In embodiments, any suitable or desired functionalization of the surface can be applied in a variety of manners, including grafting by conjugation and thiol chemistries, grafting of DNA and RNA oligomers, etc. In embodiments, the at least one hybrid metallic toner component is a hybrid metallic-wax particle comprising a wax particle having disposed thereon a metal layer, wherein the metal is selected from the group consisting of aluminum, gold, silver, zinc, platinum, chromium, titanium, copper-zinc alloys, and combinations thereof.

The wax particles can be formed by any suitable or desired process. In embodiments wherein the hybrid metal toner component is a hybrid metallic-wax particle, the formed wax particles can be dried using any suitable or desired method including, but not limited to, spray drying or freeze drying. The dried wax particles are then spread onto a substrate, such as glass, and coated with a thin film of metal. The metal can be coated onto the wax particle using any suitable or desired process. In embodiments, the metal layer is coated onto the wax particle using a thin metal deposition process, such as sputter coating or e-beam deposition. In embodiments, sputter coating is selected for conformal coating and e-beam coating is selected for directional coating. In embodiments, the metal layer is a thin film layer having a thickness of from about 1 nanometer to about 500 nanometers. In embodiments, the metal layer is a thin film layer having a thickness of from about 1 nanometer to about 10 nanometers. The coated wax particles can be dispersed in an electrolyte with surfactant using any suitable or desired process, such as sonication or shear, to break up aggregates in a similar manner as used when preparing a pigment dispersion. The formed hybrid metal-wax particle is then used as a raw material dispersion in a toner process, in embodiments, an emulation aggregation process, in place of metal pigment. Thus, the toner herein comprises a "pigment" which is a metal-organic hybrid instead of an all metal pigment. The wax particle can be formed from any suitable or desired wax.

Wax dispersions may also be added during formation of a latex polymer in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

In embodiments, the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, and combinations thereof.

In embodiments, the wax is selected from the group consisting of polyethylene, polypropylene, and mixtures thereof.

Examples of polypropylene and polyethylene waxes include those commercially available from Allied Chemical and Baker Petrolite, wax emulsions available from Michelman Inc. and the Daniels Products Company, EPOLENE® N-15 commercially available from Eastman Chemical Products, Inc., VISCOL® 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL® 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in any suitable or desired amount, such as an amount of from about 0.1 to about 30 percent by weight, and in embodiments from about 2 to about 20 percent by weight of the toner.

Colorants.

In embodiments, the present toners comprise metal integrated latex particles, metal integrated wax particles, metal integrated colorant particles, or a combination thereof. The toner may optionally include a hybrid metallic-colorant particle as described herein. The toner may optionally include an additional colorant selected from the group consisting of dyes, pigments, and combinations thereof, alone or in combination with the hybrid metallic-colorant particle of the present embodiments.

In embodiments, the at least one hybrid metallic toner component is a hybrid metallic-colorant particle comprising a colorant particle having a surface and a metal layer disposed on the colorant particle surface; wherein the metal layer is disposed so as to form a coating over essentially all of the colorant particle surface; or wherein the metal layer is disposed so as to form a coating over a portion of the colorant particle surface.

In further embodiments, a portion of the colorant particle surface is coated with a first metal layer and a separate portion of the colorant surface is coated with a second metal layer that is different from the first metal layer. In still further embodiments, a portion of the colorant particle surface is coated with one or more metal layers and a separate portion of the colorant particle surface is coated with a non-metal coating. In embodiments, any suitable or desired functionalization can be applied in a variety of manners, including grafting by conjugation and thiol chemistries, grafting of DNA and RNA oligomers, etc. In embodiments, the at least one hybrid metallic toner component is a hybrid metallic-colorant particle comprising a colorant core having disposed thereon a metal layer, wherein the metal is selected from the group consisting of aluminum, gold, silver, zinc, platinum, chromium, titanium, copper-zinc alloys, and combinations thereof.

The colorant particles can be formed by any suitable or desired process. In embodiments wherein the hybrid metal toner component is a hybrid metallic-colorant particle, the formed colorant particles can be dried using any suitable or desired method including, but not limited to, spray drying or freeze drying. The dried colorant particles are then spread onto a substrate, such as glass, and coated with a thin film of metal. The metal can be coated onto the colorant particle using any suitable or desired process. In embodiments, the metal layer is coated onto the colorant particle using a thin metal deposition process, such as sputter coating or e-beam deposition. In embodiments, sputter coating is selected for conformal coating and e-beam coating is selected for directional coating. In embodiments, the metal layer is a thin film layer having a thickness of from about 1 nanometer to about 500 nanometers. In embodiments, the metal layer is a thin film layer having a thickness of from about 1 nanometer to about 10 nanometers. The coated colorant particles can be dispersed in an electrolyte with surfactant using any suitable or desired process, such as sonication or shear, to break up aggregates in a similar manner as used when preparing a pigment dispersion. The formed hybrid metal-colorant particle is then used as a raw material dispersion in a toner process, in embodiments, an emulation aggregation process, in place of metal pigment. Thus, the toner herein comprises a "pigment" which is a metal-organic hybrid instead of an all metal pigment. The colorant particle can be formed from any suitable or desired colorant.

Any suitable or desired colorant can be selected in embodiments herein including various known suitable colorants, such as dyes, pigments, mixtures of dyes, mixtures of pigments, mixtures of dyes and pigments, and the like, which may be included in the toner or colorant dispersions herein. These colorants can be used as the core for the present hybrid metallic-colorant particle or alone as the toner colorant.

In embodiments, the colorant can be, for example, carbon black, cyan, yellow, magenta, red, orange, brown, green, blue, violet, or mixtures thereof.

In certain embodiments, the colorant is selected from the group consisting of dyes, pigments, and combinations of dyes and pigments. As examples of suitable colorants, mention may be made of carbon black such as REGAL 330® (Cabot), Carbon Black 5250 and 5750 (Columbian Chemicals), Sunsperse® Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE® 6000, FLEXIVERSE® and AQUATONE® water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM® YELLOW FGL™, HOSTAPERM® PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180, and Permanent Yellow FGL. Colored magnetites, such as mixtures of MAPICO BLACK™, and cyan components may also be selected as colorants. Other known colorants can be selected, such as Levanyl® Black A-SF (Miles, Bayer) and Sunsperse® Carbon Black LHD 9303 (Sun Chemicals), and colored dyes such as Neopen® Blue (BASF), Sudan Blue OS (BASF), PV Fast Blue B2G01 (American Hoechst), Sunsperse® Blue BHD 6000 (Sun Chemicals), Irgalite® Blue BCA (Ciba-Geigy), Paliogen® Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen® Orange 3040 (BASF), Ortho® Orange OR 2673 (Paul Uhlich), Paliogen® Yellow 152, 1560 (BASF), Lithol® Fast Yellow 0991K (BASF), Paliotol® Yellow 1840 (BASF), Neopen® Yellow (BASF), Novoperm® Yellow FG 1 (Hoechst), Permanent Yellow YE 0305 (Paul Uhlich), Lumogen® Yellow D0790 (BASF), Sunsperse® Yellow YHD 6001 (Sun Chemicals), Suco-Gelb® L1250 (BASF), Suco-Yellow® D1355 (BASF), Hostaperm® Pink E (American Hoechst), Fanal® Pink D4830 (BASF), Cinquasia® Magenta (DuPont), Lithol® Scarlet D3700 (BASF), Toluidine Red (Aldrich), Scarlet for Thermoplast NSD PS PA (Ugine Kuhlmann of Canada), E.D. Toluidine Red (Aldrich), Lithol® Rubine Toner (Paul Uhlich), Lithol® Scarlet 4440 (BASF), Bon Red C (Dominion Color Company), Royal® Brilliant Red RD-8192 (Paul Uhlich), Oracet® Pink RF (Ciba-Geigy), Paliogen® Red 3871K (BASF), Paliogen® Red 3340 (BASF), Lithol® Fast Scarlet L4300 (BASF), combinations of the foregoing, and the like.

In embodiments, organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, and Neopen Black X55.

The dyes can be present in any suitable or desired amount, in embodiments, in an amount of from about 0.5 to about 20, or from about 5 to about 20 percent, by weight percent of the toner.

In certain embodiments wherein the colorant is a pigment, the pigment may be, for example, carbon black, phthalocyanines, quinacridones or RHODAMINE B™ type, red, green, orange, brown, violet, yellow, fluorescent colorants, and the like.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, and the like, and combinations thereof, may be utilized as the colorant.

When used in a toner, the colorant may be included in the toner any suitable or desired amount, in embodiments, the colorant may be included in the toner in an amount of from about 0.1 to about 35 percent by weight of the toner, or from about 1 to about 25 weight percent of the toner, or from about 2 to about 15 percent by weight of the toner.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidene fluoride, mixtures of resins not in close proximity in the tribo electric series such as polyvinylidene fluoride and acrylics, thermosetting resins such as acrylics, combinations thereof and other known components.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Example 1

A monolayer of particle, such as latex, can be deposited on a substrate, such as a silicon wafer, in a variety of manners and dried (i.e., by evaporative methods). Metallic coating of the particle can be conducted in a variety of ways documented in literature to achieve the desired effect. For conformal coating as shown in FIG. 1, a standard sputter coater can be used to coat particulate with metal(s) to the desired thickness. Directional coating methods, such as e-beam deposition, can be used to coat the material as shown in FIG. 2 to form a bipolar particle. Achieving patterned coating on particles as shown in FIGS. 3 and 4 requires embedding the particle in a removable substrate, such as a polydimethyl siloxane mold to shield portion of the particle during the coating process. The particle can then be released from the mold (i.e., by dissolving mold with solvent) and the particulate can be reclaimed and redeposited on a substrate, or a mold, such that the metal coating process can be repeated on a different surface. This multi-step process can be repeated to achieve the pattern desired. When metallic coatings are completed in any way, not limited to the ones described above, the particles can be released from the substrate or mold and dispersed into a desired electrolyte containing salt and surfactant to form a suspension suitable for emulsion aggregation processes.

Example 2

A metallic-wax particle can be prepared in the same manner described for a latex particle in Example 1.

Example 3

A metallic-colorant particle can be prepared in the same manner described for a latex particle in Example 1.

Example 4

Black Toner Preparation. Into a 2 liter glass reactor equipped with an overhead mixer can be added 128 grams of a metallic-latex suspension, where the latex is an amorphous polyester latex, 122 grams of metallic-latex suspension where the latex is a branched amorphous polyester, 30 grams of a metallic-latex suspension which can be prepared as described in Example 1 where the latex is a crystalline polyester, 4.5 weight percent grams of polyethylene wax dispersion obtained from IGI, and 5.5 percent by weight Nipex® 35 carbon black pigment, 0.9 grams Dowfax® surfactant, and 390 grams deionized water can be combined to form a slurry. The slurry can be pH adjusted to 4.5 using 0.3M nitric acid. Then, 2.7 grams of aluminum sulphate mixed with 33 grams deionized water can be added to the slurry under homogenization at 3,000 to 4,000 revolutions per minute (RPM). The reactor can be set to 260 RPM and heated to 47° C. to aggregate the toner particles. When the particle sized reaches 4.5 micrometers, a shell coating can be added consisting of 46 grams of an amorphous polyester, and pH can be adjusted to 6 using 0.3M nitric acid. When the particle sized reaches 4.8 to 5.0 micrometers, a second shell coating can be added consisting of 46 grams of amorphous polyester emulsion, 43 grams of branched amorphous polyester emulsion and all pH can be adjusted to 6 using 0.3M nitric acid. The reaction can be further heated to 53° C. When the toner particle sized reaches 5.6 to 6.5 micrometers, freezing can be started by adjusting the pH of the slurry to 4.5 using a 4 percent NaOH solution. The reactor RPM can be decreased to 240 followed by adding 5.77 grams of a chelating agent (VERSENE™ 100) and more NaOH solution until the pH reached 8.1. The reactor temperature can be ramped to 85° C. The pH of the slurry can be maintained at 8.1 or greater until the temperature reached 85° C. (coalescence temperature). Once at the coalescence temperature, the slurry pH can be reduced to 7.3 using a pH 5.7 Buffer and coalesced for 80 minutes where the particle circularity can be between 0.970 and 0.980 as measured by the Malvern® Sysmex® FPIA3000 Flow Particle Image Analysis (FPIA) instrument. The slurry can then be quenched cooled in 360 grams of deionized ice. The final particle size may be 5.77 micrometers, GSDv 1.22, and circularity of 0.971. The toner can then be washed and freeze-dried.

Example 5

A toner containing a hybrid metallic-wax particle can be prepared in the same manner described for metallic-latex particle where polyethylene wax dispersion can be substituted for a metallic-wax particulate suspension.

Example 6

A toner containing a hybrid metallic-colorant particle can be prepared in the same manner described for metallic-latex particle where the Nipex® 35 carbon black pigment can be substituted for a metallic-colorant particle.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner process comprising:

providing at least one hybrid metallic toner component selected from the group consisting of hybrid metallic-latex particles comprising latex particles having a metallic layer coated thereover, hybrid metallic-wax particles comprising wax particles having a metallic layer coated thereover, hybrid metallic-colorant particles comprising colorant particles having a metallic layer coated thereover, and combinations thereof;

contacting the at least one hybrid metallic toner component with one or more components selected from the group consisting of a latex polymer, a wax; and a colorant to form a blend;

heating the blend at a temperature below the glass transition temperature of the latex polymer to form aggregated toner particles;

adding a coalescing agent to the toner particles thereby coalescing the toner particles; and recovering the toner particles.

2. The toner process of claim 1, wherein the at least one hybrid metallic toner component is a hybrid metallic-latex particle comprising a resin latex particle having a surface and a metal layer disposed on the latex particle surface;

wherein the metal layer is disposed so as to form a coating over essentially all of the latex particle surface; or wherein the metal layer is disposed so as to form a coating over a portion of the latex particle surface.

3. The toner process of claim 1, wherein the at least one hybrid metallic toner component is a hybrid metallic-latex particle comprising a resin latex particle having disposed thereon a metal layer, wherein the metal is selected from the group consisting of aluminum, gold, silver, zinc, platinum, chromium, titanium, copper-zinc alloys, and combinations thereof.

4. The toner process of claim 1, wherein the at least one hybrid metallic toner component is a hybrid metallic-latex particle comprising a resin latex particle having disposed thereon a metal layer, wherein the latex resin is an amorphous polyester, a crystalline polyester, or a mixture thereof; or wherein the at least one hybrid metallic toner component is a hybrid metallic-latex particle comprising a resin latex particle having disposed thereon a metal layer, wherein the latex resin is selected from the group consisting of styrenes, acrylates, methacrylates, butadienes, isoprenes, acrylic acids, methacrylic acids, acrylonitriles, and combinations thereof.

5. The toner process of claim 1, wherein the at least one hybrid metallic toner component is a hybrid metallic-wax particle comprising a wax particle having a surface and a metal layer disposed on the wax particle surface;

wherein the metal layer is disposed so as to form a coating over essentially all of the wax particle surface; or wherein the metal layer is disposed so as to form a coating over a portion of the wax particle surface.

6. The toner process of claim 1, wherein the at least one hybrid metallic toner component is a hybrid metallic-wax particle comprising a wax particle having disposed thereon a metal layer, wherein the metal is selected from the group consisting of aluminum, gold, silver, zinc, platinum, chromium, titanium, copper-zinc alloys, and combinations thereof.

7. The toner process of claim 1, wherein the at least one hybrid metallic toner component is a hybrid metallic-wax particle comprising a wax particle having disposed thereon a metal layer, wherein the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, and combinations thereof.

8. The toner process of claim 1, wherein the at least one hybrid metallic toner component is a hybrid metallic-wax particle comprising a wax particle having disposed thereon a metal layer, wherein the wax is selected from the group consisting of polyethylene, polypropylene, and mixtures thereof.

9. The toner process of claim 1, wherein the at least one hybrid metallic toner component is a hybrid metallic-colorant particle comprising a colorant particle having a surface and a metal layer disposed on the colorant particle surface;

wherein the metal layer is disposed so as to form a coating over essentially all of the colorant particle surface; or wherein the metal layer is disposed so as to form a coating over a portion of the colorant particle surface.

10. The toner process of claim 1, wherein the at least one hybrid metallic toner component selected from the group consisting of a hybrid metallic-latex particle comprising a resin latex particle having a surface and a metal layer disposed on the latex particle surface; a hybrid metallic-wax particle comprising a wax particle having a surface and a metal layer disposed on the wax particle surface; a hybrid metallic-colorant particle comprising a colorant particle having a surface and a metal layer disposed on the colorant particle surface; and combinations thereof;

wherein the metal layer is a thin film layer having a thickness of from about 1 nanometer to about 10 nanometers.

11. The toner process of claim 10, wherein the metal layer is disposed so as to form a coating over essentially all of the particle surface; or wherein the metal layer is disposed so as to form a coating over a portion of the particle surface.

12. The toner process of claim 1, further comprising:

adding a second latex polymer to the aggregated toner particles to form a shell over the aggregated toner particles thereby forming a core-shell toner;

adding the coalescing agent to the toner particles, and subsequently heating the core-shell toner with the coalescing agent at a temperature above the glass transition temperature of the second latex polymer.

13. The toner process of claim 12, wherein the second latex polymer comprises a latex polymer; or a second hybrid metallic-latex particle comprising a resin latex particle having a surface and a metal layer disposed on the latex particle surface, wherein the second hybrid metallic-latex particle is the same or different from the first hybrid metallic-latex particle.

14. The toner process of claim 1, wherein the toner process is an emulsion aggregation process.

15. An emulsion aggregation toner comprising:

a toner particle which is the product of an emulsion aggregation process of at least one hybrid metallic toner component selected from the group consisting of hybrid metallic-latex particles comprising latex particles having a metallic layer coated thereover, hybrid metallic-wax particles comprising wax particles having a metallic layer coated thereover, hybrid metallic-colorant particles comprising colorant particles having a metallic layer coated thereover, and combinations thereof;

a resin;

an optional a wax; and an optional colorant.

16. The toner of claim 15, wherein the at least one hybrid metallic toner component is a hybrid metallic-latex particle comprising a resin latex particle having a surface and a metal layer disposed on the latex particle surface;

wherein the metal layer is disposed so as to form a coating over essentially all of the latex particle surface; or wherein the metal layer is disposed so as to form a coating over a portion of the latex particle surface.

17. The toner of claim 16, wherein the at least one hybrid metallic toner component is a hybrid metallic-wax particle comprising a wax particle having a surface and a metal layer disposed on the wax particle surface;

wherein the metal layer is disposed so as to form a coating over essentially all of the wax particle surface; or wherein the metal layer is disposed so as to form a coating over a portion of the wax particle surface.

18. The toner of claim 16, wherein the at least one hybrid metallic toner component is a hybrid metallic-colorant particle comprising a colorant particle having a surface and a metal layer disposed on the colorant particle surface;

wherein the metal layer is disposed so as to form a coating over essentially all of the colorant particle surface; or wherein the metal layer is disposed so as to form a coating over a portion of the colorant particle surface.

19. The toner of claim 16, wherein the metal is selected from the group consisting of aluminum, gold, silver, zinc, platinum, chromium, titanium, copper-zinc alloys, and combinations thereof.

20. The toner of claim 16, wherein the toner comprises a core and a shell disposed thereover;

wherein the core comprises at least one hybrid metallic toner component; and wherein the shell comprises a latex polymer; or a second hybrid metallic toner component, wherein the second hybrid metallic toner component is the same or different from the hybrid metallic toner component in the core.

21. The toner of claim 15, wherein the toner comprises dry toner particles.

22. An emulsion aggregation toner comprising:

a toner particle which is the product of an emulsion aggregation process of at least one hybrid metallic toner component selected from the group consisting of hybrid metallic-latex particles, hybrid metallic-wax particles, and hybrid metallic-colorant particles;

wherein the at least one hybrid metallic toner component comprises a Janus particle wherein one side of the particle surface is coated with a metal layer and the other side is uncoated;

a resin;

an optional a wax; and an optional colorant.

23. An emulsion aggregation toner comprising:

a toner particle which is the product of an emulsion aggregation process of at least one hybrid metallic toner component selected from the group consisting of hybrid metallic-latex particles, hybrid metallic-wax particles, and hybrid metallic-colorant particles; a resin, a wax, and an optional colorant;

wherein a portion of the at least one hybrid metallic toner component is coated with a metal layer and a portion of the at least one hybrid metallic toner component is coated with a non-metal layer; or wherein a portion of the at least one hybrid metallic toner component is coated with a metal layer comprising a first metal and a portion of the at least one hybrid metallic toner component is coated with a metal layer comprising a second metal that is different from the first metal.

* * * * *